US005813297A

United States Patent [19]

Zepkowski

[11] Patent Number: 5,813,297

[45] Date of Patent: Sep. 29, 1998

[54] SCREW DRIVING TOOL

[76] Inventor: John Zepkowski, R.D. 2, Canton, Pa. 17724

[21] Appl. No.: 799,390

[22] Filed: Feb. 11, 1997

Related U.S. Application Data

[60] Provisional application No. 60/012,731, Mar. 4, 1996.

[51] Int. Cl.[6] ..... B25B 7/02

[52] U.S. Cl. ..... 81/426.5; 81/367; 81/180.1; 81/436; 81/461

[58] Field of Search ..... 81/418, 424.5, 81/426, 426.5, 180.1, 184, 367, 368, 436, 442, 448, 451, 454, 461, 186

[56] References Cited

U.S. PATENT DOCUMENTS

| | | | |
|---|---|---|---|
| 1,750,817 | 3/1930 | Root | 81/426 |
| 3,859,874 | 1/1975 | Joeckel | 81/424.5 |
| 4,542,669 | 9/1985 | Roux | 81/367 |
| 5,347,670 | 9/1994 | Duguette et al. | 7/107 |

*Primary Examiner*—David Scherbel
*Assistant Examiner*—Joni B. Danganan

[57] ABSTRACT

The invention relates to a tool having first and second cooperating jaws connected by a pivot. Each jaw includes a gripping surface and two side surfaces, and each jaw has a nose end that is remote from the pivot. Handle means causes the jaws to close about the pivot. There is a groove in the gripping surface of each of the jaws extending to the nose end of the jaw. The grooves lie along the longitudinal axis that lies in a plane extending between the gripping surfaces of the closed jaws. A cavity that is deeper than the grooves is formed in both of the jaws at the ends of the grooves opposite the nose.

1 Claim, 3 Drawing Sheets

SCREW DRIVING TOOL

This application claims priority of U.S. Provisional application Ser. No. 60/012,731 filed Mar. 4, 1996.

BACKGROUND

Much effort (both mental and physical) is required to keep a screw driver blade in a slot-head or Phillips-head screw. I have found that while employing a conventional screw driver, it is very difficult to start most types of screws into the medium into which they are to be inserted. This difficulty is increased if the material into which the screw is being installed is hard and presents resistance to penetration. When driving slot-head screws, it is difficult to keep the bit or blade lined up in the center of the screw head. This problem is especially noticeable if the tool user has bad eye sight or if the work area is not well lighted.

As a conventional screw driver is rotated, much axial exertion must be applied to the end of the handle to keep the blade in the slot of the screw head during installation of a screw. In addition, effort is required to keep the screw driver rotating. Moreover, the blade will often disengage from the screw head as the screw driver is rotated. The blade can then damage the finish of the surface adjacent the point where the screw is being inserted.

FIG. 1 shows a conventional pair of locking pliers 10 that has two handles at one end and a pair of jaws at the other end. Handle 12 is provided with a release lever 14, and handle 16 is provided with a threaded member 18 that can be rotated to adjust the spacing between jaws 20 and 22 at which locking ccurs. Jaw 22 pivots about pivot point 13. Jaws 20 and 22 have opposing serrated gripping surfaces, two side surfaces and a back surface opposite the gripping surface. Longitudinal axis 24 of the closed jaws extends to the side of handle 16 opposite handle 12. Longitudinal axis 24 of the closed jaws is located as follows. When the two jaws are closed, the two gripping surfaces contact for at least a short distance near nose end 11. A plane containing axis 24 lies substantially along the region of jaw surface contact. Axis 24 lies midway between the edges of intersection of the jaw contact surface and the two side surfaces of each jaw.

If one attempts to secure a screw in the jaws of tool 10, the jaws clamp onto the screw head and the screw is free to wobble when its tip is pressed against a workpiece. When, after much patience and concentration, the screw tip has been made to enter the workpiece, it is difficult to rotate the screw since longitudinal axis 24 of the jaw faces is not located along or between handles 14 and 16.

BRIEF DESCRIPTION OF THE INVENTION

It is an object of the invention to provide a tool that greatly simplifies the task of placing or starting a screw. Another object is to provide a tool for inserting screws without requiring push force on the screw to keep the tool engaged with the screw.

One aspect of the invention relates to a tool having first and second cooperating jaws connected by a pivot. Each jaw includes a gripping surface and two side surfaces, and each jaw has a nose end that is remote from the pivot. Handle means causes the jaws to close about the pivot. There is a groove in the gripping surface of at least one of the jaws extending to the nose end of the jaw.

Preferably, there is a groove in the gripping surface of each of the jaws. The groove lies along the longitudinal axis that lies in a plane extending between the gripping surfaces of the closed jaws. A cavity that is deeper than the groove is preferably formed in both of the jaws at the ends of the grooves opposite the nose.

In one embodiment a cavity is formed in both of the jaws at the ends of the grooves opposite the nose, the cavity being deeper than the grooves. The cavity can be formed of a slot in the gripping surface of each jaw transverse to the axis, or it can comprise a deepening of the slots.

In a further embodiment there is a groove in the gripping surface of one of the jaws, and the mating surface of the other of the jaws has a protrusion that is aligned with the groove.

The longitudinal axis preferably extends through one of the handles or between the handles to facilitate the insertion of a screw into a workpiece surface. When the tool is a pair of locking pliers, the first handle being rigidly connected to one of the jaws, a bracket can be affixed to that end of the first handle opposite the pivot, the bracket including a rod that extends along the longitudinal axis away from the handle. The rod can be inserted into the chuck of a drill that is employed to rotate the screw.

When the tool includes a cavity formed in both of the jaws at the end of the groove opposite the nose, the cavity being deeper than the groove, it can further include a blade-like protrusion in the cavity of at least one of the jaws for engaging the slot in the head of a screw that is secured between the jaws.

Another aspect of the invention concerns a method of inserting a screw into the surface of a workpiece. A screw is inserted between the jaws of a tool that includes first and second cooperating jaws connected by a pivot. Each jaw includs a gripping surface and two side surfaces, and each jaw has a nose end that is remote from the pivot. Handle means is connected to the jaws for causing them to close about the pivot. There is a groove in the gripping surface of at least one of the jaws, the groove lying along the longitudinal axis and extending to the nose end of the jaw. A cavity is formed in both of the jaws at the end of the groove opposite the nose, the cavity being deeper than the groove. The shank portion of a screw is inserted between the jaws so that the shank lies within the groove with the head of the screw extending into the cavity. The tool is advanced toward the workpiece so the tip of the screw pierces the surface of the workpiece. The tool is then rotated to cause the screw to advance into the workpiece.

In an embodiment wherein the tool includes a blade-like protrusion in the cavity of at least one of the jaws, the step of inserting the screw between the jaws includes inserting the blade-like protrustion into the slot in the head of the screw while securing the screw between the jaws.

DESCRIPTION OF PREFERRED EMBODIMENTS

Figure 1:
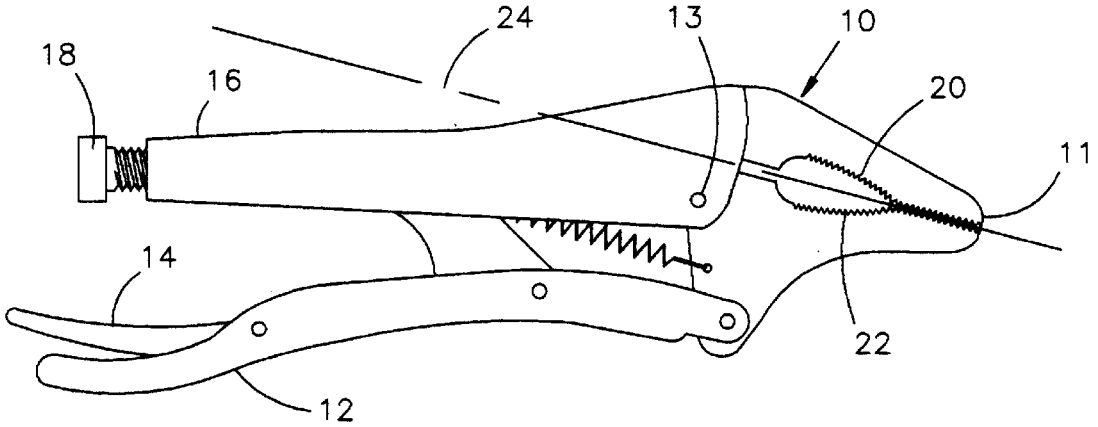
FIG. 1 (PRIOR ART)
FIG. 1 shows a conventional pair of locking pliers.
Figure 2:
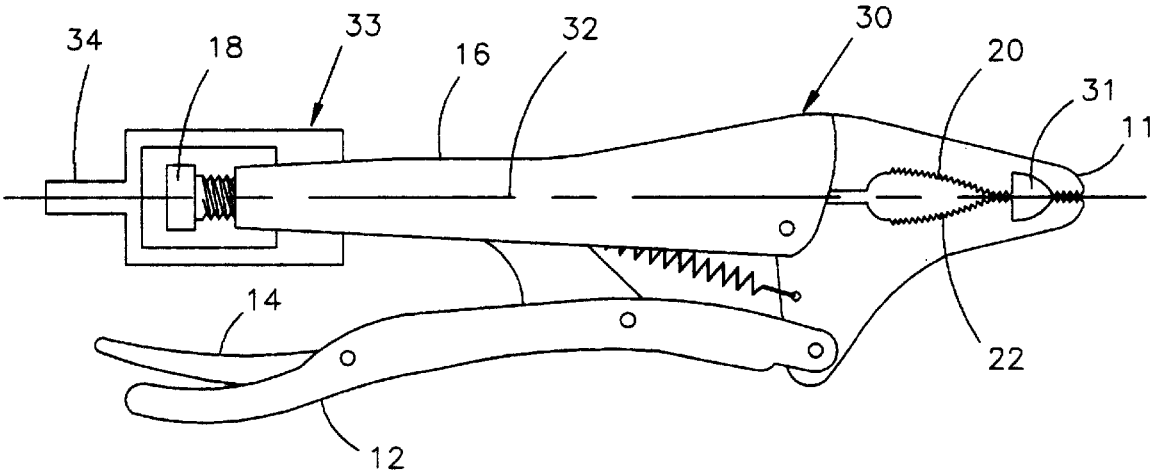
FIG. 2 is a side elevational view of a first embodiment of the invention.

One embodiment of the tool of the present invention is shown in FIG. 2. Elements of tool 30 that are similar to those of FIG. 1 are represented by the same reference numerals. Tool 30 is basically similar to the locking pliers of FIG. 1 in that it has two handles 12 and 16 and a pair of jaws 20 and 22. Handle 12 is provided with a release lever 14, and handle 16 is provided with threaded member 18. The midpoint between the closed portion of jaws 20 and 22 extends along an axis 32 which extends through handle 16.

The ends of jaws 20 and 22 adjacent end 11 have grooves that extend along the length of the jaws. The grooves will be discussed in greater detail in conjunction with FIGS. 4 and 5. A pocket or cavity 31 that is spaced a short distance from end 11 communicates with the grooves. Cavity 31 is of sufficient size to accomodate the head of a screw when the shank portion of the screw is clamped in the grooves. The cavity can be formed by cutting slots 52 and 53 in the gripping surfaces of the two jaws transverse to the longitudinal axis 32. Alternatively, the cavity can be a deepening and a widening of each slot, in which case the cross-section would appear as that of FIG. 5 except that the slots would be deeper and wider.

A bracket 33 (see FIGS. 2 and 3) has two arms that are affixed to opposite sides of handle 16. The bracket arms extend along and are spaced from threaded member 18 so that member 18 can be freely rotated. A rod 34, which is affixed to the end of bracket 33, extends along axis 32. Rod 34 is adapted to be inserted into a drill chuck. Tool 30 can thus be rotated by a drill in order to drive screws.

Whereas FIG. 2 shows a bracket for attaching tool 30 to a drill, handle or the like, it is obvious that, in its basic form, it need not include such a bracket, as tool 30 can be hand held during use.

Figure 4:
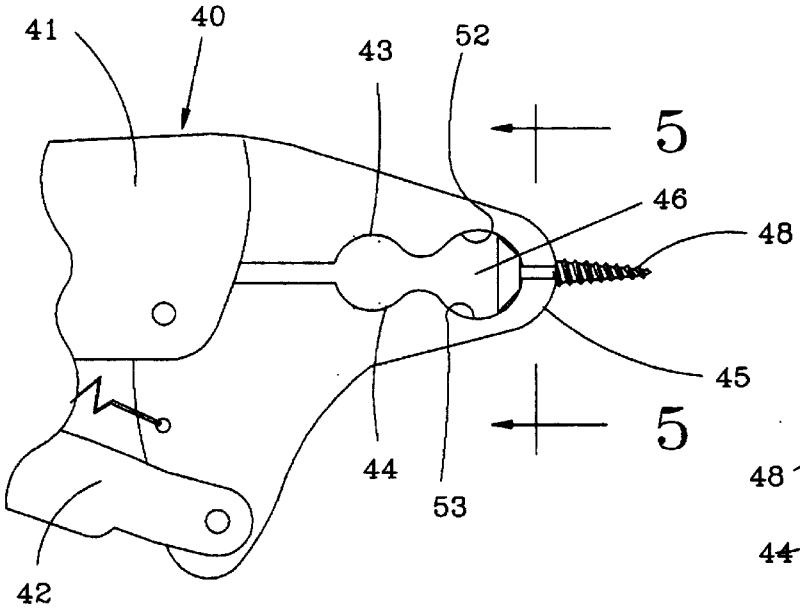
FIG. 4 is a partial side elevational view of the jaw end of a tool holding a screw.
Figure 5:
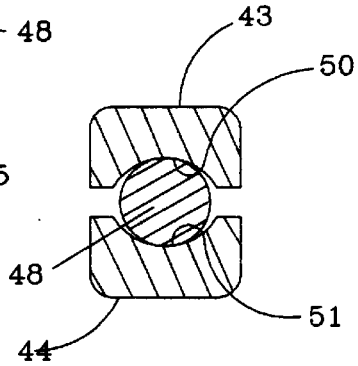
FIG. 5 is a cross-sectional view taken along lines 5—5 of FIG. 4.

FIG. 4 shows a tool 40 having handles 41 and 42. The ends of jaws 43 and 44 adjacent end 45 have grooves 50 and 51 (see FIG. 5) that extend between cavity 46 and end 45. Cavity 46 is large enough to accomodate the head of screw 48 when the shank portion of the screw is clamped in grooves 50 and 51. As shown in FIG. 5, the width of each groove is greater than the depth thereof. The cross-sectional shape of the grooves can be arcuate.

When screw 48 is inserted into tool 40 and the jaws are closed, the body of the screw is gripped by the bottoms of the grooves. The ideal location for the grooved jaws to grip the screw is the shank portion of the screw immediately adjacent the head. When the jaws have been closed to locking position, the screw is automatically aligned with the tool.

Figure 6:
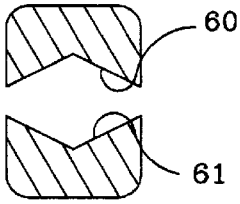
FIGS. 6, 7 and 8 are cross-sectional views of jaws having different shapes.
Figure 7:
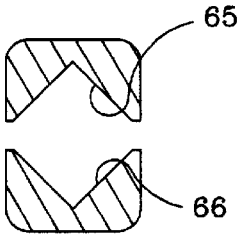

The jaws can have various cross-sectional configurations some of which are shown in FIGS. 5, 6, 7 and 8. The grooves 60 and 61 of FIG. 6 are suitable for gripping two corners of a hex head nut. The grooves 65 and 66 of FIG. 7 are suitable for gripping two corners of a square head nut. One of the jaws of FIG. 8 has a groove 68 in which a round object can be placed; the other jaw 69 has an anvil-shaped protrusion in order to bear upon the object. The cross-section shown in FIG. 8 enables the tool to securely hold round objects of different sizes.

Figure 9:
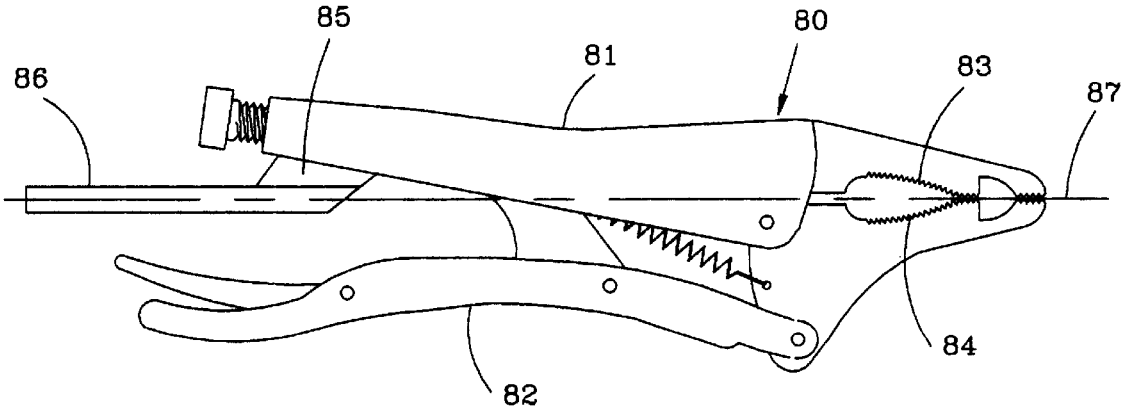
FIGS. 9 and 10 show other embodiments of the invention.

FIG. 9 shows a tool 80 having handles 81 and 82 and jaws 83 and 84. The jaws are centered on axis 87 which extends between handles 81 and 82. To provide tool 80 with the capability of being driven by a drill, a rod 86 is secured to a bracket 85 that is affixed to handle 81. Rod 86, which is centered on axis 87, is suitable for insertion into the drill chuck.

It is preferred that the axis through the jaws extend along handle 16 (axis 32 of FIG. 2) or between the handles (axis 87 of FIG. 9). However, the tool of the present invention is still useful if the jaw axis extends beyond handle 16 as shown in FIG. 1.

Figure 3:
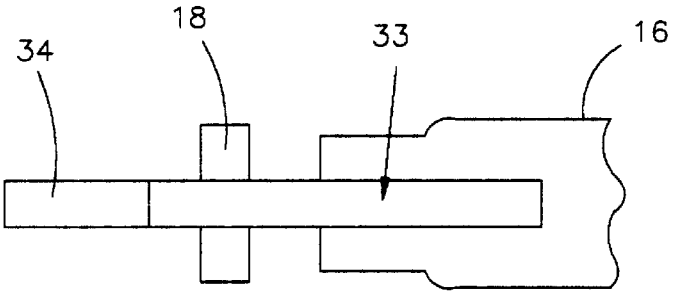
FIG. 3 is a partial top view of a portion of the tool of FIG. 2.
Figure 8:
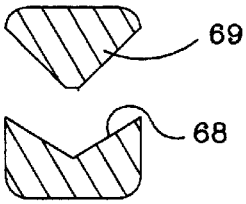

Rod 34 of FIGS. 2 and 3 and rod 86 of FIG. 8 could be hexagonally-shaped so that they fit into a standard screw driver handle of the type into which different screw driver blades or tips can be inserted. Hexagonally-shaped rods 34 and 86 would also fit into a standard motorized screw driver. Rods 34 and 86 could also be magnetized so that they are better retained by such handles.

Figure 10:
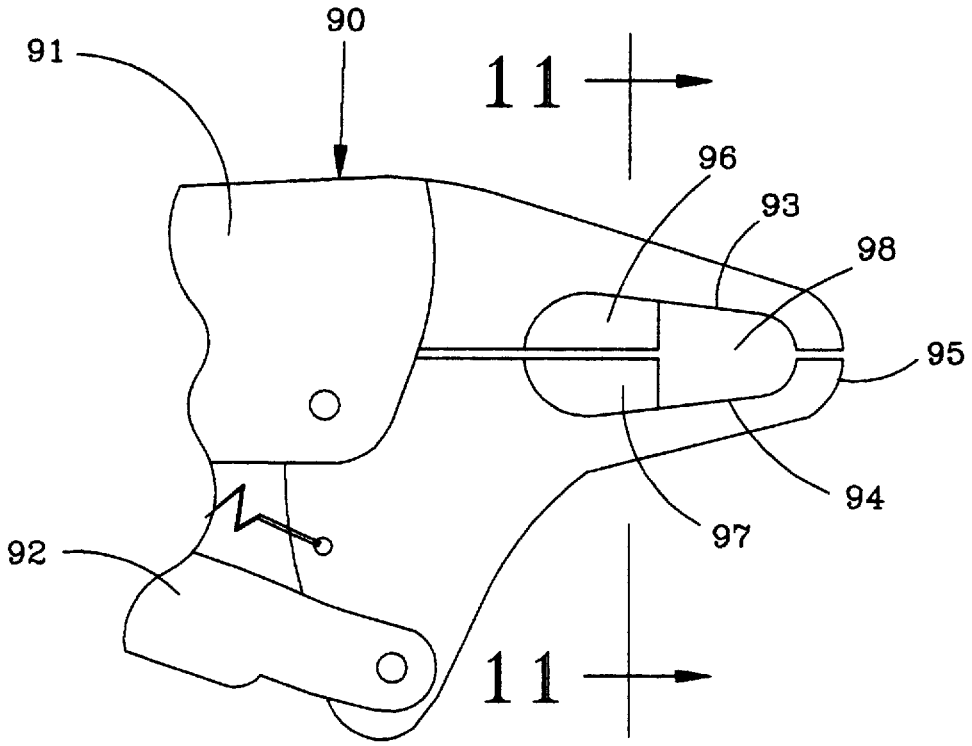
Figure 11:
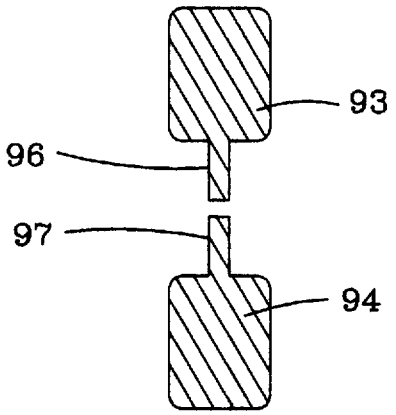
FIG. 11 is a cross-sectional view taken along lines 11—11 of FIG. 10.

FIGS. 10 and 11 shows a tool 90 having handles 91 and 92. The ends of jaws 93 and 94 adjacent end 95 have grooves similar to those discussed above that extend between cavity 98 and end 95. Jaws 93 and 94 are provided with blade-like protrusions 96 and 97, respectively, that extend toward each other. When jaws 93 and 94 are closed on a screw, these protrusions cooperate to form a blade that can extend into the slot of the screw. This causes the tool to grip the screw even more tightly.

Whereas the tool of FIGS. 10 and 11 is especially adapted for the insertion of slot-head screws, it could also insert Phillips-head screws by placing the head slightly in front of protrusions 96 and 97. Then, the grooved jaws 93 and 94 would secure the screw. Moreover, the shapes of protrusions could be modified so that the tool accomodates Phillips-head screws.

The above-described modified locking pliers provide a superior means for securely holding and installing wood screws, machine screws and even bolts. The screws are held straight and rigid and do not wobble or slip during installation.

The following observations have been made while using the above-described tool.

(a) With this new tool, one need not concentrate on keeping a blade in the slot of the screw head. After the screw is inserted into the tool and the handles are gripped to secure it, the screw is automatically securely aligned with respect to the handles. The screw can be easily rotated and axially advanced so that it quickly bites into the wood or other medium. If desired, it can be screwed to within a short distance from the required depth, perhaps ⅛ inch or so. The tool is disengaged from the screw, and a conventional manual or electric screw driver can advance the screw the remainder of the distance into the workpiece.

(b) I have installed many slot-head screws with the tool described above, and the blade has never disengaged from the slot in the screw head.

(c) One can experience difficulty when attempting to start a small wood screw such as a No. 4 screw (one-half inch length) with a conventional screw driver. Because of its small size, it is difficult to hold it between the thumb and finger while starting to screw it into wood with a conventional screw driver. It is also difficult to determine whether it is oriented perpendicular to the wood surface. It is even difficult to place the point of a small screw at the desired location as one's view is obscured by the hand. Starting a screw with the tool of this invention is as simple as placing the point of a pencil on a dot. After one has secured the screw in the grooves of the tool, one can easily observe the point of the screw and properly place it. Then, one can determine whether the tool needs to be moved at any angle with respect to the surface in order to drive the screw perpendicularly into the wood.

(d) One need not concentrate to keep the tool engaged with the screw. The tool is merely rotated to advance the screw into the surface. Once the screw "bites into" the surface of the workpiece, no axial force is required to keep the tool engaged with the screw head.

The preferred embodiments relate to locking pliers. It is obvious that conventional non-locking pliers could also be adapted in accordance with the present invention so that they could more easily grip a screw head. Such pliers differ from the previously disclosed pliers in that one handle is coextensive with one jaw and the other handle is coextensive with the other jaw. The handle-jaw members are connected by a pivot.

I claim:

1. A method of inserting a screw into the surface of a workpiece, said screw having a slot in an end thereof, said method comprising inserting said screw between the jaws of a tool that includes first and second cooperating jaws connected by a pivot, each jaw including a gripping surface and two side surfaces, each jaw having a nose end that is remote from said pivot, handle means connected to said jaws for causing said jaws to close about said pivot, a longitudinal axis extending in a plane that lies substantially along the region of jaw surface contact when the jaws are closed, said axis lying midway between the two side surfaces of each jaw, a groove in the gripping surface of at least one of said jaws, said groove lying along said longitudinal axis and extending to the nose end of said jaw, a cavity formed in both of said jaws at the end of said groove opposite said nose, said cavity being deeper than said groove, and a blade-like protrusion in the cavity of at least one of said jaws, the step of inserting said screw including inserting said screw between said jaws including inserting said blade-like protrusion into the slot in the head of said screw while inserting the shank of said screw between said jaws so that said shank lies within said groove with the head of said screw extending into said cavity, advancing said tool toward said workpiece to pierce the surface of said workpiece by the tip of said screw, and rotating said tool to cause said screw to advance into said workpiece.

* * * * *